US010214937B2

(12) United States Patent
Reddy et al.

(10) Patent No.: US 10,214,937 B2
(45) Date of Patent: Feb. 26, 2019

(54) SLINGSHOT SIDE SADDLE SUBSTRUCTURE

(71) Applicant: Nabors Drilling Technologies USA, Inc., Houston, TX (US)

(72) Inventors: Padira Reddy, Houston, TX (US); Ashish Gupta, Houston, TX (US)

(73) Assignee: Nabors Drilling Technologies USA, Inc., Houston, TX (US)

( * ) Notice: Subject to any disclaimer, the term of this patent is extended or adjusted under 35 U.S.C. 154(b) by 0 days.

(21) Appl. No.: 16/035,375

(22) Filed: Jul. 13, 2018

(65) Prior Publication Data

US 2018/0320401 A1 Nov. 8, 2018

Related U.S. Application Data

(63) Continuation of application No. 15/893,463, filed on Feb. 9, 2018, now Pat. No. 10,094,137, which is a (Continued)

(51) Int. Cl.

| | |
|---|---|
| ***E04H 12/34*** | (2006.01) |
| ***E21B 15/00*** | (2006.01) |
| *E21B 21/06* | (2006.01) |

(52) U.S. Cl.

CPC ..... *E04H 12/345* (2013.01); *E21B 15/00* (2013.01); *E21B 15/003* (2013.01); *E21B 21/063* (2013.01)

(58) Field of Classification Search

CPC ..... E21B 15/00; E21B 15/003; E21B 21/063; E04H 12/345

See application file for complete search history.

(56) References Cited

U.S. PATENT DOCUMENTS 1,733,484 A 10/1929 Davis
2,332,479 A 10/1943 Woolslayer et al.
(Continued)

FOREIGN PATENT DOCUMENTS

CA 2755483 A1 11/2010
CA 2753417 A1 2/2011
(Continued)

OTHER PUBLICATIONS

Gass, John "Declaration Under 37 C.F.R. §1.132 including Exhibits A, B, C and D" dated Jul. 24, 2017 (235 pages).
(Continued)

*Primary Examiner* — Babajide A Demuren
(74) *Attorney, Agent, or Firm* — Adolph Locklar

(57) ABSTRACT

A land-based drilling rig includes a first substructure and a second substructure, the second substructure being positioned generally parallel to the first substructure. The land-based drilling rig also includes a drill rig floor coupled to the first and second substructures, the drill rig floor including a V-door. The side of the drill rig floor has the V-door defining a V-door side of the drill rig floor, where the V-door side of the drill rig floor is parallel to the first substructure. The first and second substructures pivotably support the drill rig floor. The land-based drilling rig also includes a mast, the mast mechanically coupled to one or more of the first substructure, the second substructure, and the drill rig floor. The mast is pivotably coupled to one or more of the first substructure, the second substructure, and the drill rig floor by a mast pivot point. The mast includes a V-door side, the V-door side of the mast parallel to the first or second substructure. In addition, the land-based drilling rig includes a mast hydraulic lift cylinder coupled to the mast at a mast lift point and a choke manifold, the choke manifold positioned on the drill rig floor.

2 Claims, 5 Drawing Sheets

Related U.S. Application Data continuation of application No. 15/191,140, filed on Jun. 23, 2016, now Pat. No. 9,926,719, which is a continuation-in-part of application No. 14/616,234, filed on Feb. 6, 2015, now Pat. No. 9,708,861, which is a continuation-in-part of application No. 14/180,049, filed on Feb. 13, 2014, now Pat. No. 9,810,027.

(60) Provisional application No. 61/764,259, filed on Feb. 13, 2013.

(56) References Cited

U.S. PATENT DOCUMENTS 2,345,253 A 3/1944 Funk
2,347,115 A 4/1944 Lewis
2,594,847 A 4/1952 Bates et al.
3,028,881 A 4/1962 Koomey et al.
3,255,836 A 6/1966 Hoppmann et al.
3,433,268 A 3/1969 Greer
3,483,933 A 12/1969 Dyer et al.
3,576,225 A 4/1971 Chambers
3,676,984 A 7/1972 Clark
3,716,149 A 2/1973 Scaggs
3,739,853 A 6/1973 Wales
3,802,137 A 4/1974 Armstrong
3,851,770 A 12/1974 Jenkins et al.
3,922,825 A * 12/1975 Eddy ..... E21B 15/00 173/151
3,937,334 A 2/1976 Bleyl et al.
3,942,593 A * 3/1976 Reeve, Jr. ..... E21B 7/023 173/186
3,991,887 A 11/1976 Trout
4,021,978 A 5/1977 Busse et al.
4,029,165 A 6/1977 Miller et al.
RE29,541 E 2/1978 Russell
4,117,941 A 10/1978 McCleskey et al.
4,221,088 A 9/1980 Patterson
4,235,566 A * 11/1980 Beeman ..... E21B 19/155 175/85
4,267,675 A 5/1981 Cochran
4,290,495 A 9/1981 Elliston
4,403,898 A * 9/1983 Thompson ..... E21B 19/155 175/85
4,407,629 A 10/1983 Willis
4,421,179 A 12/1983 Boyadjieff
4,473,977 A 10/1984 Reed
4,474,254 A 10/1984 Etter et al.
4,478,015 A 10/1984 Lawrence et al.
4,478,291 A 10/1984 Futros
4,488,708 A 12/1984 Frye
4,493,382 A 1/1985 Collins et al.
4,587,778 A 5/1986 Woolslayer et al.
4,744,710 A 5/1988 Reed
4,757,592 A 7/1988 Reed
4,759,414 A 7/1988 Willis
4,823,870 A 4/1989 Sorokan
4,834,604 A * 5/1989 Brittain ..... E21B 19/155 175/85
4,850,439 A 7/1989 Lund
4,899,832 A 2/1990 Bierscheid, Jr.
4,979,578 A 12/1990 Landry
5,107,940 A 4/1992 Berry
5,248,005 A 9/1993 Mochizuki
5,305,833 A 4/1994 Collins
5,375,667 A 12/1994 Trevisani
5,492,436 A * 2/1996 Suksumake ..... E02B 17/00 166/366
5,921,336 A 7/1999 Reed
6,161,358 A * 12/2000 Mochizuki ..... E21B 15/00 405/201
6,491,477 B2 12/2002 Bennett, Jr. et al.
6,581,525 B2 6/2003 Smith
6,634,436 B1 * 10/2003 Desai ..... E21B 7/02 173/1
6,779,614 B2 * 8/2004 Oser ..... E21B 19/15 166/85.1
6,848,515 B2 2/2005 Orr et al.
6,955,223 B2 10/2005 Orr et al.
6,962,030 B2 11/2005 Conn
6,976,540 B2 12/2005 Berry
7,228,919 B2 6/2007 Fehres et al.
7,255,180 B2 8/2007 Beato et al.
7,306,055 B2 * 12/2007 Barnes ..... E21B 7/02 175/122
7,308,953 B2 12/2007 Barnes
7,401,656 B2 7/2008 Wood et al.
7,600,585 B2 * 10/2009 Patton ..... E21B 7/027 166/384
7,628,229 B2 12/2009 Wood et al.
7,765,749 B2 8/2010 Palidis
7,819,207 B2 10/2010 Cowan
7,832,974 B2 * 11/2010 Fikowski ..... E21B 19/155 414/22.54
7,878,254 B2 2/2011 Abdollahi et al.
7,931,076 B2 4/2011 Ditta et al.
7,967,540 B2 6/2011 Wright et al.
7,992,646 B2 * 8/2011 Wright ..... E21B 19/155 166/379
8,051,930 B1 11/2011 Barnes et al.
8,181,698 B2 5/2012 Springett et al.
8,297,362 B1 10/2012 Strider et al.
8,316,588 B2 * 11/2012 Cicognani ..... E21B 15/00 52/118
8,468,753 B2 * 6/2013 Donnally ..... E21B 7/02 173/186
8,474,216 B1 7/2013 Goerner
8,516,751 B2 8/2013 Konduc et al.
8,549,815 B2 * 10/2013 Donnally ..... E21B 15/00 52/118
8,555,564 B2 10/2013 Wasterval
8,561,685 B2 10/2013 Rodgers
8,661,743 B2 3/2014 Flusche
8,720,128 B2 * 5/2014 Vogt ..... E21B 15/00 173/28
8,813,436 B2 8/2014 Donnally et al.
8,863,449 B2 10/2014 Donnally et al.
8,904,716 B2 12/2014 Donnally et al.
8,985,928 B2 3/2015 Flusche
8,997,435 B2 4/2015 Reddy et al.
9,016,004 B2 4/2015 Vogt
9,027,287 B2 5/2015 Trevithick et al.
9,091,125 B2 7/2015 Konduc et al.
9,091,126 B2 7/2015 Thiessen et al.
9,132,871 B2 9/2015 Crisp et al.
9,140,080 B2 9/2015 Flusche
9,151,412 B2 10/2015 Trevithick et al.
9,163,462 B2 10/2015 Donnally et al.
9,212,481 B2 12/2015 Stramandinoli
9,228,394 B2 1/2016 Wijning et al.
9,249,626 B2 2/2016 Flusche
9,260,929 B2 2/2016 Mark
9,267,328 B2 2/2016 Flusche
9,309,728 B2 4/2016 Reddy et al.
9,291,012 B2 5/2016 Wells, Sr.
9,334,668 B2 5/2016 Wijning et al.
9,353,601 B2 5/2016 Hause
9,382,766 B2 7/2016 Flusche
9,399,890 B2 7/2016 Mark
9,441,423 B2 9/2016 Donnally et al.
9,366,053 B2 10/2016 Thiessen et al.
9,464,488 B2 10/2016 Thiessen
9,488,014 B2 11/2016 Sparkman et al.
9,562,407 B2 2/2017 Magnuson
9,631,443 B2 4/2017 Folk
9,650,840 B2 5/2017 Cheng et al.
9,708,861 B2 7/2017 Reddy et al.
9,739,098 B2 8/2017 Fox
9,790,751 B2 10/2017 Reddy et al.
9,810,027 B2 11/2017 Reddy et al.
9,845,813 B2 12/2017 Shimizu et al.
9,879,442 B2 1/2018 Magnuson et al.
9,926,719 B2 3/2018 Reddy et al.

(56) References Cited

U.S. PATENT DOCUMENTS

| | | | | |
|---|---|---|---|---|
| 2002/0001255 | A1 | 1/2002 | Flood et al. | |
| 2003/0155154 | A1* | 8/2003 | Oser | E21B 19/15 175/52 |
| 2003/0172599 | A1 | 9/2003 | Frink | |
| 2004/0211598 | A1* | 10/2004 | Palidis | E21B 7/02 175/162 |
| 2006/0104746 | A1* | 5/2006 | Thompson | E21B 19/155 414/22.54 |
| 2008/0237170 | A1 | 10/2008 | Altman et al. | |
| 2009/0000218 | A1 | 1/2009 | Lee et al. | |
| 2009/0025980 | A1 | 1/2009 | Callander et al. | |
| 2009/0053013 | A1 | 2/2009 | Maltby | |
| 2009/0200856 | A1* | 8/2009 | Chehade | E21B 7/02 299/30 |
| 2009/0218138 | A1* | 9/2009 | Donnally | E21B 7/023 175/57 |
| 2009/0272540 | A1 | 11/2009 | Rodgers | |
| 2010/0186960 | A1* | 7/2010 | Reitsma | E21B 21/08 166/305.1 |
| 2011/0072737 | A1* | 3/2011 | Wasterval | E21B 7/021 52/115 |
| 2011/0174545 | A1 | 7/2011 | Hartke et al. | |
| 2012/0138327 | A1* | 6/2012 | Sorokan | E21B 7/02 173/189 |
| 2012/0168179 | A1 | 7/2012 | Having et al. | |
| 2012/0304553 | A1 | 12/2012 | Konduc et al. | |
| 2013/0305632 | A1 | 11/2013 | Rivera, Sr. et al. | |
| 2014/0014417 | A1 | 1/2014 | Smith et al. | |
| 2014/0054097 | A1 | 2/2014 | Bryant | |
| 2015/0315861 | A1 | 11/2015 | Zachariasen et al. | |
| 2016/0010323 | A1* | 1/2016 | Konduc | E21B 7/02 52/69 |
| 2016/0186495 | A1 | 6/2016 | Flusche | |
| 2016/0215592 | A1 | 7/2016 | Helms et al. | |
| 2016/0280524 | A1 | 9/2016 | Crisp et al. | |
| 2016/0369570 | A1 | 12/2016 | Reddy et al. | |
| 2017/0106925 | A1 | 4/2017 | Gupta et al. | |
| 2017/0292334 | A1 | 10/2017 | Reddy et al. | |
| 2017/0350153 | A1 | 12/2017 | Reddy et al. | |
| 2018/0016851 | A1 | 1/2018 | Reddy et al. | |
| 2018/0030788 | A1 | 2/2018 | Reddy et al. | |
| 2018/0119496 | A1 | 5/2018 | Reddy et al. | |
| 2018/0128056 | A1 | 5/2018 | Gupta et al. | |

FOREIGN PATENT DOCUMENTS

| | | | |
|---|---|---|---|
| CN | 201778661 | U | 3/2011 |
| DE | 849533 | C | 9/1952 |
| EP | 2751370 | B1 | 7/2014 |
| FR | 2556042 | A1 | 6/1985 |
| WO | 2016025521 | A2 | 2/2016 |
| WO | 2016048458 | A1 | 3/2016 |

OTHER PUBLICATIONS

Nabors 990 Proyecto Llanos.WMV; https://www.youtube.com/watch?v=6BgfgWumRIU, Nabors Rig 990 Chichimene, Colombia; Youtube.com; Aug. 10, 2011 (231 pages).

Drilling Contractor; "Nabors modular Rig 702 in Papua New Guinea-bound for Exxon Mobil"; Drilling Contractor, in Drilling Rigs & Automation, News, Jul. 6, 2011; 2 pages; www.drillingcontractor.org.

Drilling Contractor; "Nabors to base all future land rigs on Minimum Area AC rig concept"; Drilling Contractor, in News, Aug. 22, 2011; 2 pages; www.drillingcontractor.org.

Sebastion, Simone; "Big drill soon begins long commute to work"; Houston Chronicle, Sunday, Jul. 3, 2011; 3 pages; www.chron.com.

Gaddy, Dean E., "Critical path analysis improves rig-moving procedures", Oil & Gas Journal, Nov. 16, 1998 (5 pages).

* cited by examiner

SLINGSHOT SIDE SADDLE SUBSTRUCTURE

CROSS-REFERENCE TO RELATED APPLICATIONS

This application is a continuation of U.S. application Ser. No. 15/893,463, filed Feb. 9, 2018, which is a continuation of Ser. No. 15/191,140, filed Jun. 23, 2016, now issued as U.S. Pat. No. 9,926,719, which is a continuation in part which claims priority from U.S. application Ser. No. 14/616,234, filed Feb. 6, 2015, now issued as U.S. Pat. No. 9,708,861, and U.S. application Ser. No. 14/180,049 filed Feb. 13, 2014, now issued as U.S. Pat. No. 9,810,027. U.S. application Ser. No. 14/616,234 is itself a continuation in part of U.S. application Ser. No. 14/180,049, which is itself a non-provisional application which claims priority from U.S. provisional application No. 61/764,259, filed Feb. 13, 2013.

FIELD OF THE DISCLOSURE

The present disclosure relates generally to drilling rigs, and specifically to slingshot rig structures for land drilling in the petroleum exploration and production industry.

BACKGROUND OF THE DISCLOSURE

Land-based drilling rigs may be configured to be traveled from location to location to drill multiple wells within the same area known as a wellsite. In certain situations, it is necessary to travel across an already drilled well for which there is a well-head in place. Further, mast placement on land-drilling rigs may have an effect on drilling activity. For example, depending on mast placement on the drilling rig, an existing well-head may interfere with the location of land-situated equipment such as, for instance, existing well-heads, and may also interfere with raising and lowering of equipment needed for operations.

SUMMARY

The present disclosure provides for a land based drill rig. The land based drill rig may include a first and a second lower box, the lower boxes positioned generally parallel and spaced apart from each other. The land based drill rig may further include a drill rig floor. The drill rig floor may be coupled to the first lower box by a first strut, the first lower box and first strut defining a first substructure. The drill rig floor may also be coupled to the second lower box by a second strut, the second lower box and second strut defining a second substructure. The struts may be hingedly coupled to the drill rig floor and hingedly coupled to the corresponding lower box such that the drill rig floor may pivot between an upright and a lowered position. The drill rig floor may include a V-door oriented to generally face one of the substructures.

The present disclosure also provides for a land based drilling rig. The land based drilling rig may include a first and a second lower box, the lower boxes positioned generally parallel and spaced apart from each other. The land based drill rig may further include a drill rig floor. The drill rig floor may be coupled to the first lower box by a first strut, the first lower box and first strut defining a first substructure. The drill rig floor may also be coupled to the second lower box by a second strut, the second lower box and second strut defining a second substructure. The struts may be hingedly coupled to the drill rig floor and hingedly coupled to the corresponding lower box such that the drill rig floor may pivot between an upright and a lowered position. The drill rig floor may include a V-door oriented to generally face one of the substructures. The land based drilling rig may further include a mast coupled to the drill rig floor. The land based drilling rig may further include a tank support structure affixed to the first or second substructure. The tank support structure may include a tank and mud process equipment. The land based drilling rig may further include a grasshopper positioned to carry cabling and lines to the drilling rig. The grasshopper may be positioned to couple to the drill rig floor generally at a side of the drill rig floor, and the side of the drill rig floor to which the grasshopper couples may face towards the first or second sub structure

BRIEF DESCRIPTION OF THE DRAWINGS

The summary and the detailed description are further understood when read in conjunction with the appended drawings. For the purpose of illustrating the present disclosure, there are shown in the drawings exemplary embodiments of said disclosure; however, the disclosure is not limited to the specific methods, compositions, and devices disclosed. In addition, the drawings are not necessarily drawn to scale. In the drawings.

DETAILED DESCRIPTION

The present disclosure may be understood more readily by reference to the following detailed description, taken in connection with the accompanying figures, which form a part of this disclosure. It is to be understood that this disclosure is not limited to the specific devices, methods, applications, conditions or parameters described and/or shown herein, and that the terminology used herein is for the purpose of describing particular embodiments by way of example only and is not intended to be limiting of the present disclosure. Also, as used in the specification, including the appended claims, the singular forms "a," "an," and "the" include the plural, and reference to a particular numerical value includes at least that particular value, unless the context clearly dictates otherwise. The term "plurality," as used herein, means more than one.

Figure 1:
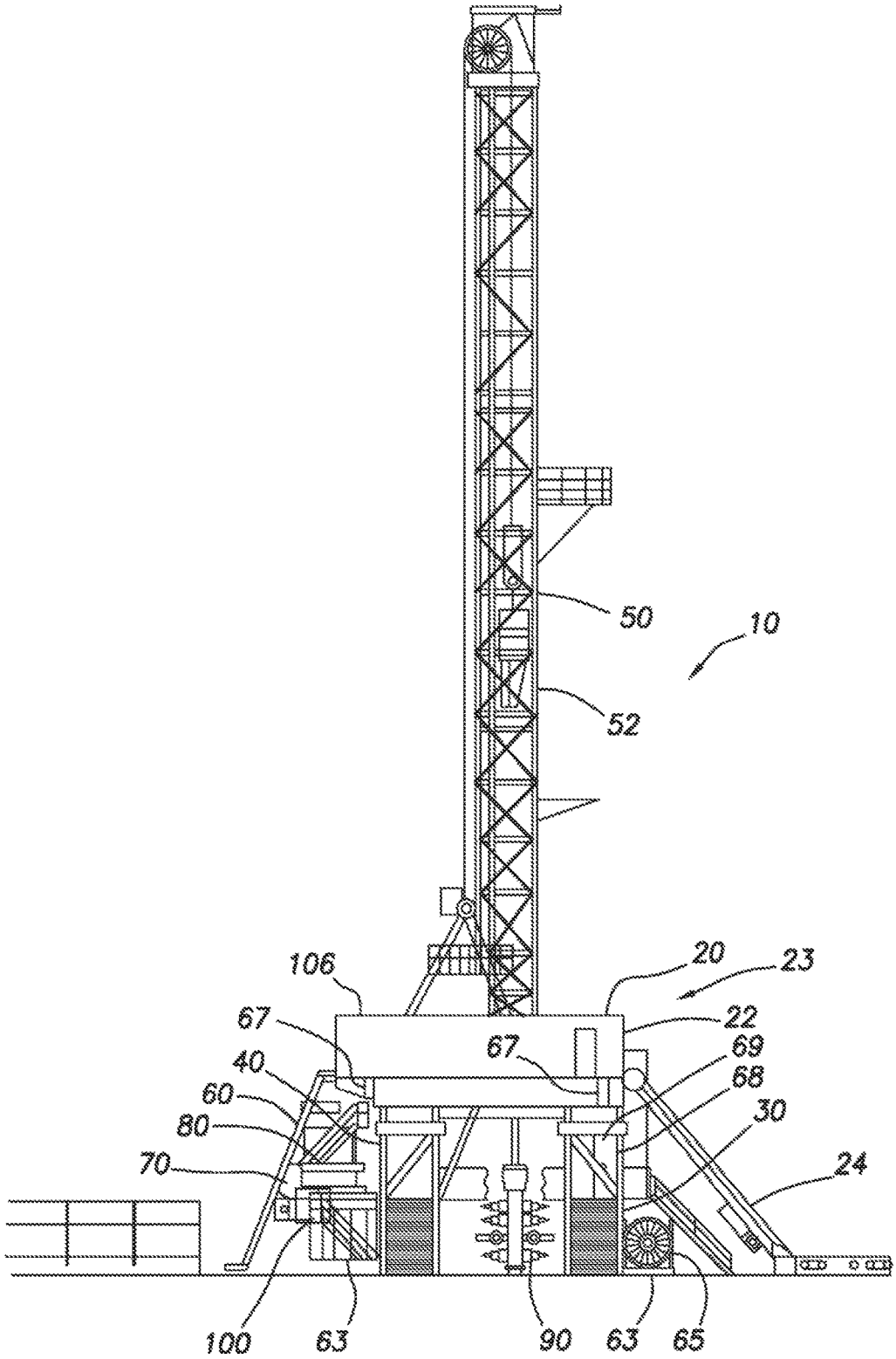
FIG. 1 is a side elevation from the driller's side of a drilling rig consistent with at least one embodiment of the present disclosure.

FIG. 1 depicts a side elevation of drilling rig 10 from the "driller's side" consistent with at least one embodiment of the present disclosure. Drilling rig 10 may include drill rig floor 20, right substructure 30, and left substructure 40. Right and left substructures 30, 40 may support drill rig floor 20. Mast 50 may be mechanically coupled to one or both of right and left substructures 30, 40 or drill rig floor 20. As would be understood by one having ordinary skill in the art with the benefit of this disclosure, the terms "right" and "left" as used herein are used only to refer to each separate substructure to simplify discussion, and are not intended to limit this disclosure in any way. In some embodiments, drill rig floor 20 may include V-door 23, defining a V-door side of drill rig floor 20 and V-door side 22 of drilling rig 10. V-door 23 and V-door side 22 may be located over right substructure 30. The V-door side 52 of mast 50 may correspondingly face right substructure 30. Pipe handler 24 may be positioned to carry piping through a V-door as understood in the art positioned on V-door side 22 of drilling rig 10. In some embodiments, grasshopper 60 may be positioned to carry cabling and lines to drilling rig 10. In other embodiments (not shown), V-door side 22 and mast V-door side may face left substructure 40. In some embodiments, as depicted in FIG. 1, blow out preventer 90 may be located between left substructure 40 and right substructure 30, i.e. drilling rig 10 may be centered over a wellbore.

In some embodiments, tank support structure 80 and tanks 70 may be included in drilling rig 10. Tank support structure 80 may be affixed to right substructure 30 or left substructure 40 by means known to those of ordinary skill in the art with the benefit of this disclosure, including, but not limited to, welding and bolting. As shown in FIG. 1, tank support structure 80 may be affixed to left substructure 40. Tank support structure 80 may be located on the opposite substructure from V-door side 22 of drilling rig 10. Tanks 70 may, for example, be mud tanks, auxiliary mud tanks, or other tanks useful in drilling operations and may be located within tank support structure 80. In some embodiments, mud process equipment 100 may also be mounted within tank support structure 80. Mud process equipment may include, for example, shakers, filters, and other equipment associated with the use of drilling mud.

In some embodiments, tank support structure 80 may be mechanically coupled to right substructure 30 or left substructure 40 by one or more equipment support cantilevers 63. In some embodiments, one or more equipment support cantilevers 63 may be hingedly coupled to one or both of right and left substructures 30, 40. Equipment support cantilevers 63 may be utilized to support one or more pieces of drilling rig equipment mechanically coupled to equipment support cantilevers 63 including, for example and without limitation, tank support structure 80, drill line spooler 65, hydraulic power units (HPUs), compressors, variable frequency drives (VFDs), choke manifolds, accumulators, or other pieces of rig equipment. In some embodiments, one or more of right and left substructures 30, 40 may include one or more compartments 68. Compartments 68 may be formed in an interior of the respective right or left substructure 30, 40. In some embodiments, compartments 68 may be closed by hatch or door 69, which may close compartments 68 while allowing access thereto.

In some embodiments, one or both of right and left substructures 30, 40 may include one or more upper equipment support cantilevers 67. As depicted in FIG. 1, each upper equipment support cantilever 67 may be hingedly coupled to one of right or left substructure 30, 40. In some embodiments, upper equipment support cantilevers 67 may be utilized to support one or more pieces of drilling rig equipment mechanically coupled to upper equipment support cantilevers 67, including one or more of, for example and without limitation, mud process equipment 100, choke manifold 102, accumulator 104, mud gas separators, process tanks, trip tanks, drill line spoolers, HPU's, VFD, or driller's cabin 106.

Figure 2:
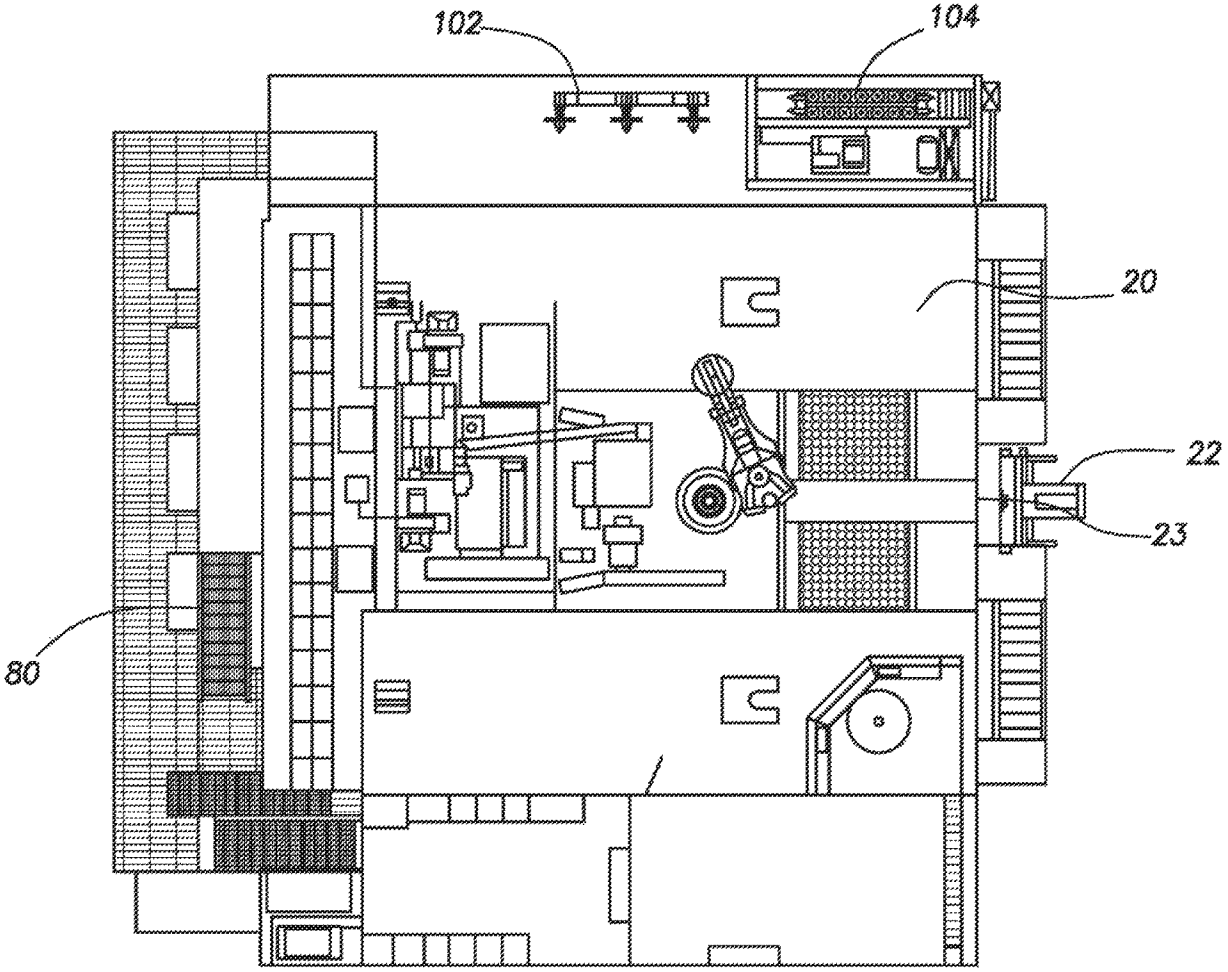
FIG. 2 is an overhead view of a drilling rig consistent with at least one embodiment of the present disclosure.

FIG. 2 depicts an overhead view of drilling rig 10 consistent with at least one embodiment of the present disclosure in which V-door side 22 of drilling rig 10, drill rig floor 20, and tank support structure 80 are shown. In some embodiments, choke manifold 102 may likewise be located on the rig floor. In some embodiments, accumulator 104 may likewise be located on the rig floor.

Figure 3:
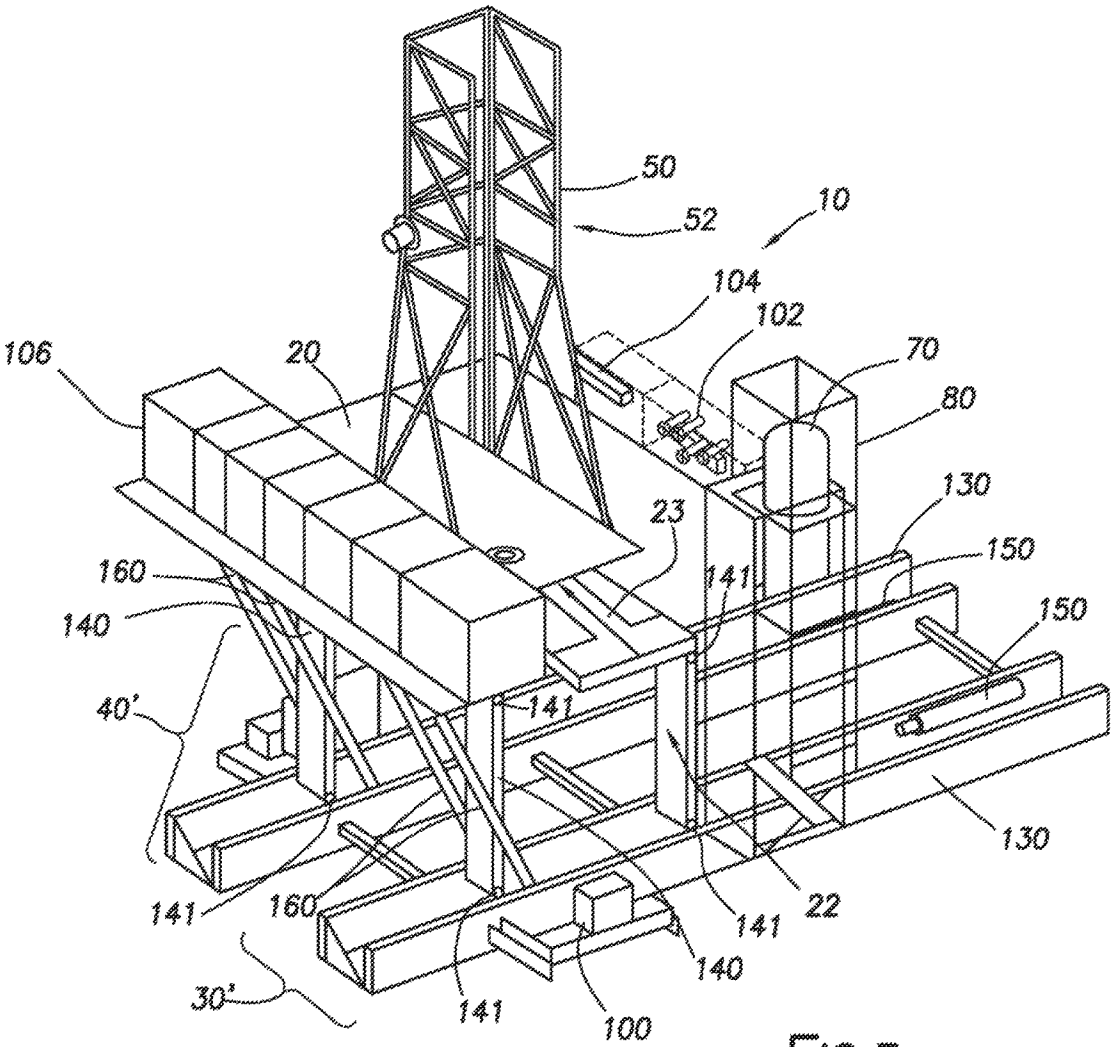
FIG. 3 is a perspective view of a drilling rig consistent with at least one embodiment of the present disclosure.

In some embodiments, substructures 30, 40 may be fixed as depicted in FIGS. 1, 2. In some embodiments, as depicted in FIG. 3, substructures 30', 40', may pivotably support drill rig floor 20. Drill rig floor 20 may be pivotably coupled to one or more lower boxes 130 by a plurality of struts 140 together forming substructures 30', 40' (pivot points shown as pivot points 141). Lower boxes 130 may support drill rig floor 20. Lower boxes 130 may be generally parallel to each other and spaced apart. Struts 140 may be hingedly coupled to drill rig floor 20 and to lower boxes 130. In some embodiments, struts 140 may be coupled to lower boxes 130 and drill rig floor 20 such that they form a bar linkage therebetween, allowing relative motion of drill rig floor 20 relative to lower boxes 130 while maintaining drill rig floor 20 parallel to lower boxes 130. Thus, drill rig floor 20 may be moved from an upper position as shown in FIG. 3 to a lower position while remaining generally horizontal.

In some embodiments, the movement of drill rig floor 20 may be driven by one or more hydraulic cylinders 150. In some embodiments, when in the upright position, one or more diagonals 160 may be coupled between drill rig floor 20 and lower boxes 130 to, for example and without limitation, maintain drill rig floor 20 in the upright position.

In some embodiments, with reference to FIGS. 1-3, as they are mounted directly to a substructure (30 or 40) of drilling rig 10, one or more pieces of equipment may travel with drilling rig 10 during a skidding operation. For example and without limitation, equipment may include tanks 70, mud process equipment 100, choke manifold 102, accumulator 104, mud gas separators, process tanks, trip tanks, drill line spoolers, HPU's, VFD, or driller's cabin 106. As such any pipe or tubing connections between or taken from tanks 70, mud process equipment 100, choke manifold 102, and/or accumulator 104 may remain connected during the skidding operations. This arrangement may allow, for example, more rapid rig disassembly ("rigging-down") and assembly (or "rigging-up") of drilling rig 10 before and after a skidding operation.

Additionally, by facing V-door side 22 of drilling rig 10 toward one of the substructures 30, 40, equipment and structures that pass through the V-door 23 or to drill rig floor 20 from V-door side 22 of drilling rig 10 may, for example, be less likely to interfere with additional wells in the well field.

Figure 4:
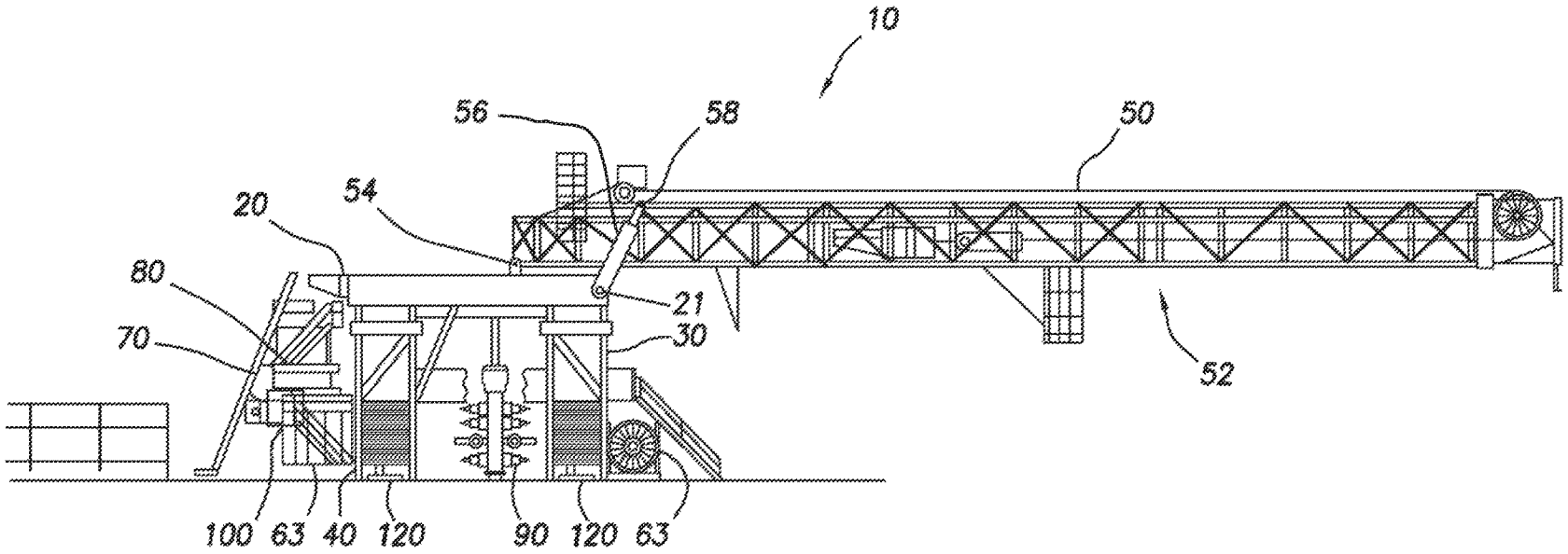
FIG. 4 is a side elevation of a drilling rig consistent with at least one embodiment of the present disclosure in a mast lowered position.
Figure 5:
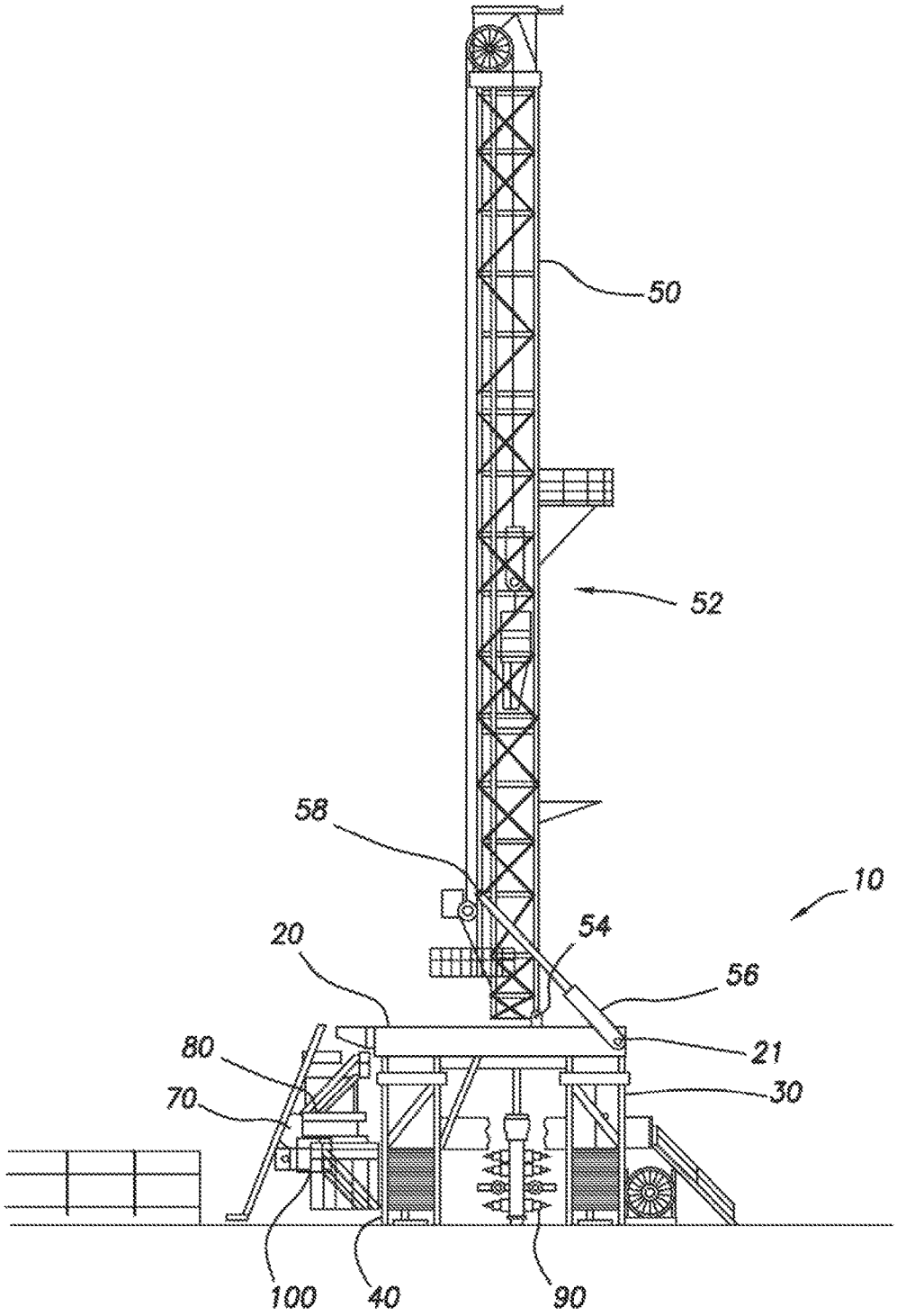
FIG. 5 is a side elevation view of the drilling rig of FIG. 4 in a mast raised position.

In some embodiments, as depicted in FIGS. 4, 5, mast 50 may be mechanically coupled to rig drill rig floor 20. In some embodiments, not depicted, mast 50 may be mechanically coupled to one or both of right and left substructures 30, 40. In some embodiments, mast 50 may be mechanically coupled to drill rig floor 20 by one or more mast pivot points 54. In some embodiments, as depicted in FIG. 4, mast 50 may be mechanically coupled to mast pivot points 54 in a horizontal position, defined as a mast lowered position of drilling rig 10. In some embodiments, mast 50 may be transported in the horizontal position. In some embodiments, mast 50 may be constructed from one or more mast subunits and may be transported in a disassembled state. In some embodiments, drilling rig 10 may include one or more hydraulic cylinders 56. Hydraulic cylinders 56 may, in some embodiments, be mechanically coupled to one of drill rig floor 20 or one or both of right and left substructures 30, 40. Hydraulic cylinders 56 may be mechanically coupled to mast 50 at one or more mast lift points 58. Once hydraulic cylinders 56 are mechanically coupled to mast 50, hydraulic cylinders 56 may be extended to raise mast 50 from the horizontal position depicted in FIG. 4 to a vertical position as depicted in FIG. 5, defined as a mast raised position of drilling rig 10. In some embodiments, hydraulic cylinders 56 may be mechanically coupled to drill rig floor 20 at one or more rig floor lifting points 21.

In some embodiments, as depicted in FIGS. 4, 5, drilling rig 10 may include one or more hydraulic walkers 120. Hydraulic walkers 120 may, in some embodiments, be positioned at a lower end of one or both right and left substructures 30, 40. In some embodiments, hydraulic walkers 120 may be hydraulically actuatable to move or walk drilling rig 10 to a different location in the wellsite. In some embodiments, hydraulic walkers 120 may be operable to move or walk drilling rig 10 in any direction. In some embodiments, equipment positioned on equipment support cantilevers 63 and upper equipment support cantilevers 67 as previously discussed may be moved with drilling rig 10 as it is moved or walked.

One having ordinary skill in the art with the benefit of this disclosure will understand that the specific configurations depicted in FIGS. 1-5 may be varied without deviating from the scope of this disclosure.

Those skilled in the art will appreciate that numerous changes and modifications can be made to the preferred embodiments of the present disclosure and that such changes and modifications can be made without departing from the spirit of said disclosure. It is, therefore, intended that the appended claims cover all such equivalent variations as fall within the true spirit and scope of said disclosure.

What is claimed is:

1. A land-based drilling rig comprising:

a first substructure;

a second substructure, the second substructure being positioned generally parallel to the first substructure;

a drill rig floor fixedly coupled to the first and second substructures wherein the drill rig floor is immovable with respect to the first and second substructures when the land-based drilling rig is assembled and set up for drilling, the drill rig floor including a V-door, the side of the drill rig floor having the V-door defining a V-door side of the drill rig floor, the V-door side of the drill rig floor parallel to the first substructure;

a mast, the mast mechanically coupled to one or more of the first substructure, the second substructure, and the drill rig floor, the mast being pivotably coupled to one or more of the first substructure, the second substructure, and the drill rig floor by a mast pivot point, the mast comprising a V-door side, the V-door side of the mast parallel to the first or second substructure;

a mast hydraulic lift cylinder coupled to the mast at a mast lift point; and an accumulator, the accumulator positioned on the drill rig floor.

2. A land-based drilling rig comprising:

a first substructure;

a second substructure, the second substructure being positioned generally parallel to the first substructure;

a drill rig floor fixedly coupled to the first and second substructures wherein the drill rig floor is immovable with respect to the first and second substructures when the land-based drilling rig is assembled and set up for drilling, the drill rig floor including a V-door, the side of the drill rig floor having the V-door defining a V-door side of the drill rig floor, the V-door side of the drill rig floor parallel to the first substructure;

a mast, the mast mechanically coupled to one or more of the first substructure, the second substructure, and the drill rig floor, the mast being pivotably coupled to one or more of the first substructure, the second substructure, and the drill rig floor by a mast pivot point, the mast comprising a V-door side, the V-door side of the mast parallel to the first or second substructure;

a mast hydraulic lift cylinder coupled to the mast at a mast lift point; and a choke manifold, the choke manifold positioned on the drill rig floor.

* * * * *